US010109190B1

(12) United States Patent
Baptiste

(10) Patent No.: US 10,109,190 B1
(45) Date of Patent: Oct. 23, 2018

(54) EMERGENCY VEHICLE WARNING SYSTEM

(71) Applicant: Danyell Baptiste, Chicago, IL (US)

(72) Inventor: Danyell Baptiste, Chicago, IL (US)

(73) Assignee: Danyell Baptiste, Chicago, IL (US)

( * ) Notice: Subject to any disclaimer, the term of this patent is extended or adjusted under 35 U.S.C. 154(b) by 0 days.

(21) Appl. No.: 15/287,533

(22) Filed: Oct. 6, 2016

Related U.S. Application Data

(60) Provisional application No. 62/239,490, filed on Oct. 9, 2015.

(51) Int. Cl.
*G08G 1/00* (2006.01)
*G08G 1/0965* (2006.01)

(52) U.S. Cl.
CPC ..... *G08G 1/0965* (2013.01)

(58) Field of Classification Search
CPC ..... G08G 1/0965
USPC ..... 340/902
See application file for complete search history.

(56) References Cited

U.S. PATENT DOCUMENTS 6,252,521 B1 * 6/2001 Griffin ..... G08G 1/0965 340/384.1
2002/0008635 A1 * 1/2002 Ewing ..... G08G 1/0965 340/902
2004/0036627 A1 * 2/2004 Knoski ..... G08G 1/0965 340/902
2011/0227756 A1 * 9/2011 Otero ..... G08G 1/096716 340/901
2013/0154852 A1 * 6/2013 Kim ..... B60Q 5/008 340/904
2014/0300455 A1 * 10/2014 Tsuzuki ..... B60Q 5/008 340/425.5

* cited by examiner

*Primary Examiner* — Fabricio R Murillo Garcia
(74) *Attorney, Agent, or Firm* — IP Patent Clinic, The John Marshall Law School

(57) ABSTRACT

An emergency vehicle warning system is a portable electronic device that detects emergency signals coming from emergency vehicles within a given radius and generates a warning in the form of audible signals, vibration, and/or lights within the vehicle to provide advanced warning to the occupants of the vehicle providing additional time to pull safely over to the side of the road to avoid accidents or tickets that may result from the failure to yield to emergency vehicles.

12 Claims, 4 Drawing Sheets

EMERGENCY VEHICLE WARNING SYSTEM

CROSS-REFERENCE TO RELATED APPLICATION

The present application is related to and claims priority from prior provisional application Ser. No. 62/239,490, filed Oct. 9, 2015 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of emergency warning devices and more specifically relates to an emergency vehicle warning system.

2. Description of the Related Art

Highway safety is an ongoing issue in today's mobile society. Over 245 million motor vehicles are on the road and, at any given time, emergency vehicles may be needed. When these emergency vehicles need the right-of-way, safety of the driving public becomes a problem. Emergency vehicle accidents are the number one cause of police officer deaths in the United States. In fact, more police officers are killed annually in auto accidents than by gunfire. Sirens, designed to warn motorists about the presence of emergency vehicles, are not always effective. Studies have shown that emergency vehicle sirens are a less than adequate means of providing advance warning of the approach of police, fire and other emergency vehicles.

As automobiles have been engineered to provide a quieter, more insulated ride, sirens have become less effective. In addition, a sound limit on sirens (118 decibels) has been established by some states and industry regulations to protect citizens from irreversible ear damage and to help preserve a calm environment. With music and noisy passengers adding to the distractions of everyday driving, the need for a better warning system becomes clear. According to government statistics, just one more second of advance warning could prevent 90 percent of both rear-end and intersection accidents. There is a need for an early warning system that can be effective even with the current restraints that are in place. A solution is needed.

Various attempts have been made to solve the above-mentioned problems such as those found in U.S. Pat. No. 7,061,402 to Robert Lawson; U.S. Pat. No. 6,404,351 to Dennis Beinke; and U.S. Publication No. 2002/0008635 to Jimmie Ewing, et al. This art is representative of emergency warning devices. None of the above inventions and patents, taken either singly or in combination, is seen to describe the invention as claimed.

Ideally, an emergency warning device should provide effective warning to occupants inside of a vehicle, even with the current alarm restrictions, and yet, would operate reliably and be manufactured at a modest expense. Thus, a need exists for a reliable emergency vehicle warning system to avoid the above-mentioned problems.

BRIEF SUMMARY OF THE INVENTION

In view of the foregoing disadvantages inherent in the known emergency warning devices art, the present invention provides a novel emergency vehicle warning system. The general purpose of the present invention, which will be described subsequently in greater detail, is to provide effective warning to occupants inside of a vehicle, even with the current alarm restrictions.

The emergency vehicle warning system for use within a motor vehicle during use may comprise a casing member including a top wall, a bottom wall, and at least one side wall forming an interior volume, a receiver unit that is located within the interior volume of the casing member and is adapted to detect audio and electronic warning signals transmitted by emergency vehicles, and an alarm member.

The receiver unit is adapted to send an electronic signal to the alarm member when an audio or electronic warning signal is received from an emergency vehicle within a given radius. The alarm member is located within the interior volume of the casing member and is adapted to receive an electronic signal from the receiver unit and to emit an alarm adapted to inform the driver of the motor vehicle of an emergency vehicle emitting an audio or electronic warning signal. The receiver unit and the alarm member are connected via electronic wiring or conductors, and may be connected via fiber optic wiring in some embodiments.

The receiver unit further includes an electronic circuit board connected thereto adapted to be programmed to desired performance specifications. The electronic circuit board is programmed such that an electronic signal is generated and sent to the alarm member only when an audio or electronic warning signal of an emergency vehicle of a chosen signal strength range is received. The alarm member may include a speaker member, a vibrator, and/or at least one light member, so that it is able to emit an audio noise, a vibration, and/or flashing lights to get the attention of the vehicle driver. The light member is preferably composed of at least one LED light member for power conservation purposes.

There may also be a power supply located within the interior volume of the casing member that is electronically connected to the receiver unit and the alarm member. The power supply may include at least one rechargeable battery member and a power cord extending outside of the casing member that is adapted to releasably connect to the power source of the motor vehicle. The power supply may include a solar panel attached to an outside surface of the casing member top wall and is adapted to collect solar energy for storage within and for use by the power supply.

At least one attachment member may be provided to connect to the outside surface of the casing member top wall to attach it to an interior surface of the motor vehicle such as the windshield or dashboard. The attachment member(s)

may be formed as hook and loop fasteners or may be formed as a double sided adhesive pad, but other suitable attachment means may also be used.

The present invention holds significant improvements and serves as a emergency vehicle warning system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, emergency vehicle warning system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a emergency warning device and more particularly to a emergency vehicle warning system as used to improve the effectiveness of warning occupants inside of a vehicle, even with the current alarm restrictions, when an emergency vehicle approaches.

Generally speaking, an emergency vehicle warning system is a portable electronic device that detects emergency signals coming from emergency vehicles within a given radius and generates a warning in the form of audible signals, vibration, and/or lights within the vehicle to provide advanced warning to the occupants of the vehicle providing additional time to pull safely over to the side of the road to avoid accidents or tickets that may result from the failure to yield to emergency vehicles.

Figure 1:
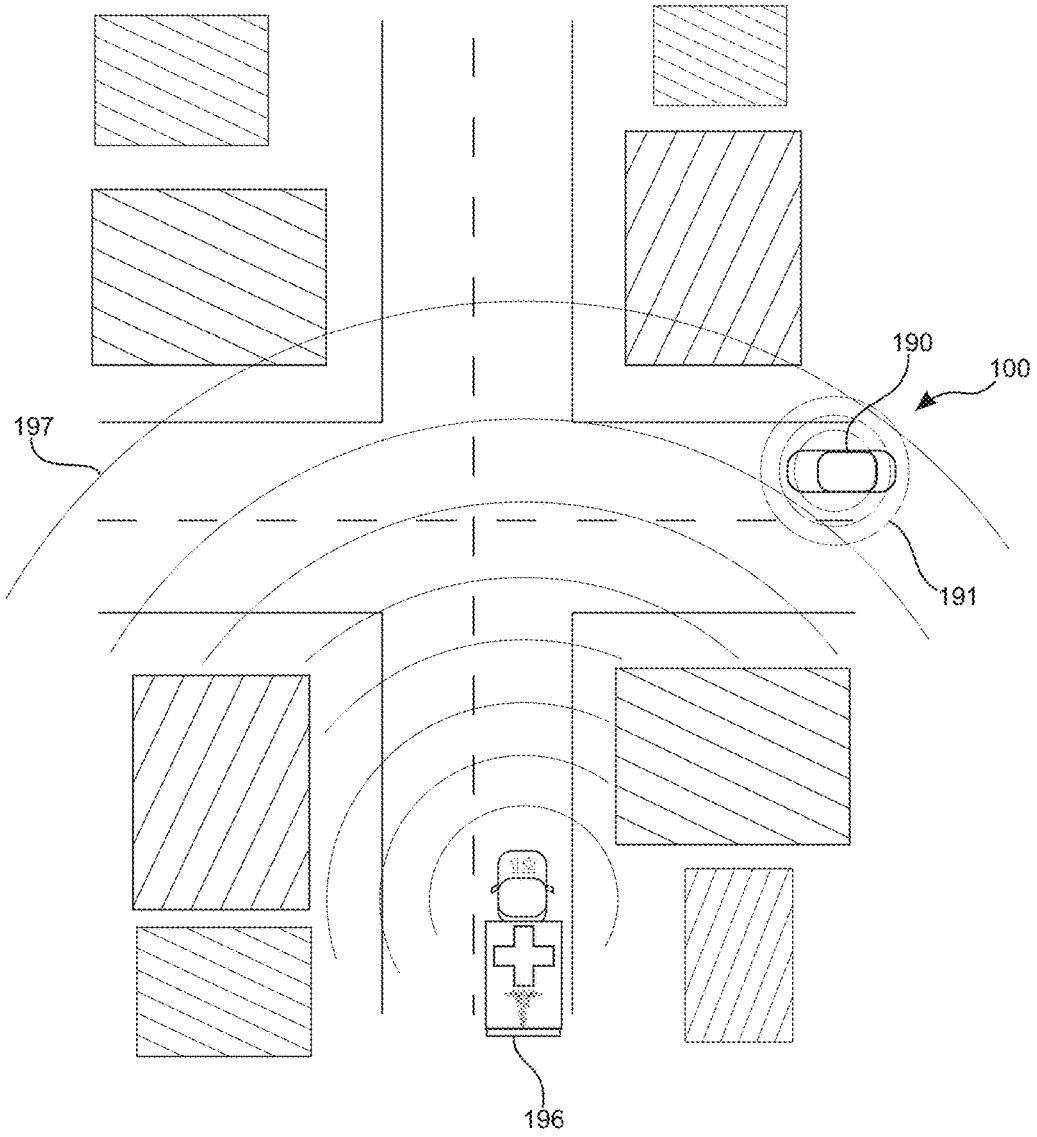
FIG. 1 shows an overhead view illustrating an emergency vehicle warning system according to an embodiment of the present invention.

Referring to the drawings by numerals of reference there is shown in FIG. 1, shows an overhead view illustrating emergency vehicle warning system 100 according to an embodiment of the present invention.

Emergency vehicle warning system 100 is portable and able to be placed within vehicle 190 powered by battery 192 or by charger 194 through the vehicles cigarette lighter or power port. The emergency vehicle warning system 100 is able to receive emergency or warning signal 197 that are transmitted by tower, satellite, or detect certain frequency sounds emitted directly from emergency vehicles 196 to alert the drivers of motor vehicles 190 in advance of an approaching emergency vehicle 196 to prevent accidents and avoid tickets from the failure to yield to emergency vehicles 196.

Receiver unit 115 is adapted to send an electronic signal to alarm member 120 when an audio or electronic warning signal is received from emergency vehicle 196 within a given radius. Alarm member 120 is located within interior volume 109 of casing member 105 and is adapted to receive an electronic signal from the receiver unit and to emit an audible alarm 191 adapted to inform the driver of motor vehicles 190 of emergency vehicle 196 emitting an audio or electronic warning signal. Receiver unit 115 and alarm member 120 are connected via electronic wiring 125 or conductors, and may be connected via fiber optic wiring 130 in some embodiments.

Figure 2:
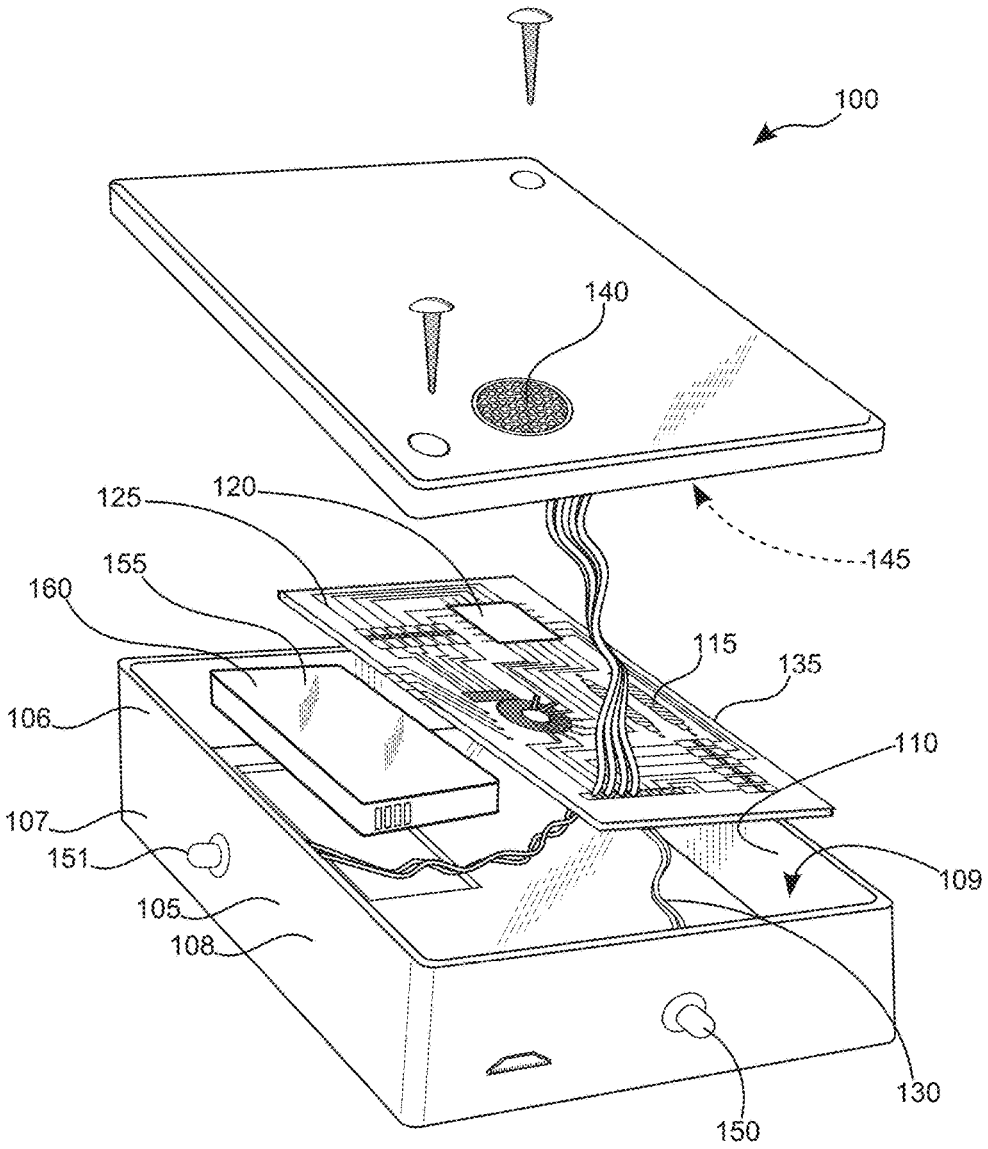
FIG. 2 is a disassembled view illustrating the emergency vehicle warning system according to an embodiment of the present invention of FIG. 1.

Referring now to FIG. 2, is an disassembled view illustrating emergency vehicle warning system 100 according to an embodiment of the present invention of FIG. 1.

Emergency vehicle warning system 100 for use within motor vehicles 190 during use may comprise casing member 105 including top wall 106, bottom wall 107, and at least one side wall 108 forming interior volume 109, receiver unit 115 that is located within interior volume 109 of casing member 105 and is adapted to detect audio and electronic warning signals transmitted by emergency vehicle 196, and alarm member 120.

Receiver unit 115 further includes electronic circuit board 135 connected thereto adapted to be programmed to desired performance specifications. Electronic circuit board 135 is programmed such that an electronic signal is generated and sent to alarm member 120 only when an audio or electronic warning signal 197 of emergency vehicle 196 of a chosen signal strength range is received. Alarm member 120 may include speaker member 140, vibrator 145, and/or at least light member 150, so that it is able to emit an audio noise, a vibration, and/or flashing lights to get the attention of motor vehicle 190 driver. Light member 150 is preferably composed of at least one led light member 151 for power conservation purposes.

Figure 3:
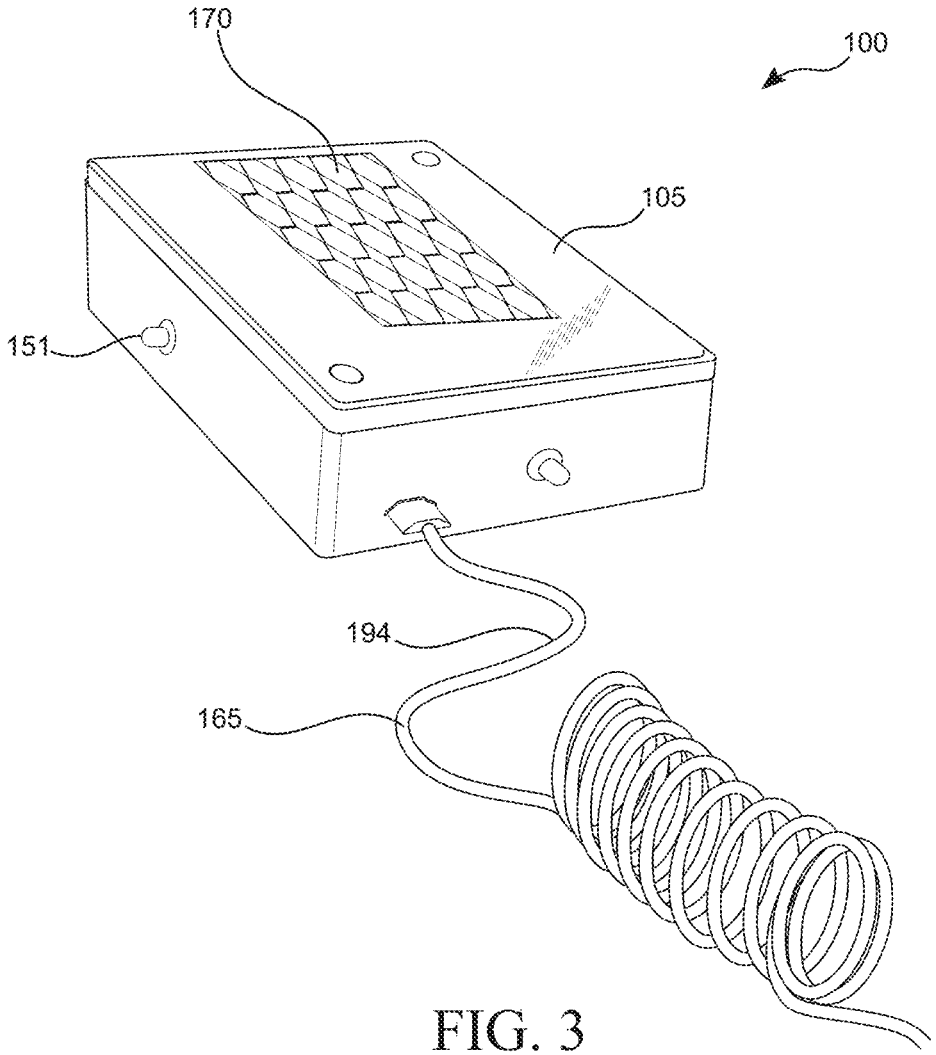
FIG. 3 is a perspective view illustrating the emergency vehicle warning system with alternative power sources according to an embodiment of the present invention of FIG. 1.

Referring now to FIG. 3, is a perspective view illustrating emergency vehicle warning system 100 with alternative power sources according to an embodiment of the present invention of FIG. 1.

There may also be power supply 155 located within interior volume 109 of casing member 105 that is electronically connected to receiver unit 115 and alarm member 120. Power supply 155 may include at least one rechargeable battery member 160 and power cord 165 extending outside of casing member 105 that is adapted to releasably connect to the power source of motor vehicle 190. Power supply 155 may include solar panel 170 attached to an outside surface of casing member 105 top wall 106 and is adapted to collect solar energy for storage within and for use by power supply 155.

Figure 4:
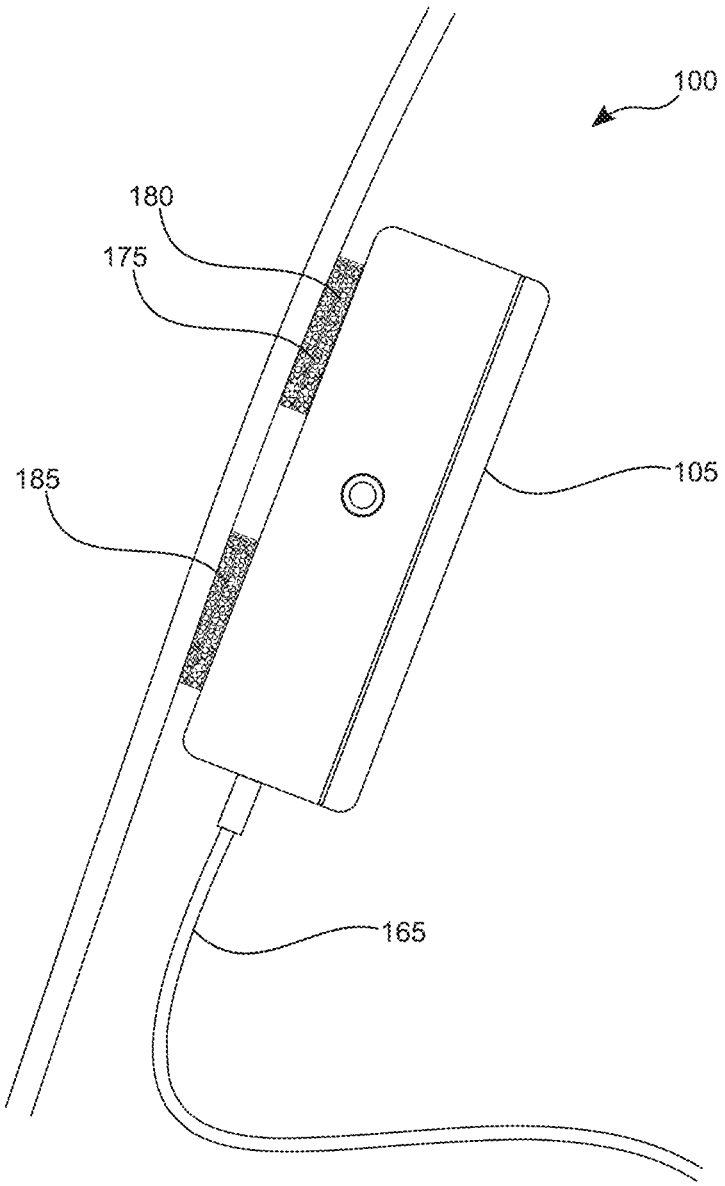
FIG. 4 is a perspective view illustrating an attachment member of the emergency vehicle warning system according to an embodiment of the present invention of FIG. 1.

Referring now to FIG. 4, is a perspective view illustrating attachment member 175 of emergency vehicle warning system 100 according to an embodiment of the present invention of FIG. 1.

At least one attachment member 175 may be provided to connect to the outside surface of casing member 105 top wall 106 to attach it to interior surface 110 of motor vehicles 190 such as the windshield or dashboard. Attachment member(s) 175 may be formed as hook and loop connectors 180 or may be formed as double sided adhesive pad 185, but other suitable attachment means may also be used.

In some embodiments, an extra accessory such as a holster may be included so that emergency vehicle warning system 100 may be removed each time the user leaves motor vehicle 190.

Emergency vehicle warning system 100 may be sold as kit comprising the following parts: at least one casing member 105 having receiver unit 115 and alarm member 120, speaker member 140, vibrator 145, LED light member 151, and rechargeable battery member 160; at least one power cord 165; at least one attachment member(s) 175; at least one charger 194; and at least one set of user instructions. The kit has instructions such that functional relationships are detailed in relation to the structure of the invention (such that the invention can be used, maintained, or the like in a preferred manner). Emergency vehicle warning system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. An emergency vehicle warning system for use within a motor vehicle during use, said emergency vehicle warning system comprising:

a casing member including:

a top wall;

a bottom wall; and at least one side wall;

wherein said top wall, said bottom wall, and said at least one side wall form an interior volume;

a receiver unit including an electronic circuit board connected thereto adapted to be programmed to desired performance specifications;

wherein said receiver unit is located within said interior volume of said casing member and is adapted to detect audio and electronic warning signals transmitted by emergency vehicles;

wherein said receiver unit is adapted to send an electronic signal to an alarm member when an audio or electronic warning signal is received from said emergency vehicles;

an alarm member;

wherein said alarm member is located within said interior volume of said casing member and is adapted to receive said electronic signal from said receiver unit and emit an alarm adapted to inform a driver of said motor vehicle of an emergency vehicle emitting an audio or electronic warning signal;

wherein said electronic circuit board is programmed such that the electronic signal is generated and sent to said alarm member only when an audio or electronic warning signal of an emergency vehicle of a chosen signal frequency is received;

wherein said alarm member includes a speaker member, and at least one light member, wherein said alarm member is adapted to emit an audio noise, and flashing lights;

a power supply;

wherein the power supply is located within said interior volume of said casing member and is electronically connected to said receiver unit and said alarm member;

a vibrator is located within said interior volume of said casing member and is adapted to emit vibrations;

wherein said vibrations are of an amplitude adapted to travel through said motor vehicle and be physically felt by a person in their extremities; and wherein said power supply includes a solar panel attached to an outside surface of said casing member top wall and is adapted to collect solar energy for storage within and to be used by said power supply.

2. The emergency vehicle warning system of claim 1, wherein said receiver unit and said alarm member are connected via electronic wiring.

3. The emergency vehicle warning system of claim 1, wherein said receiver unit and said alarm member are connected via fiber optic wiring.

4. The emergency vehicle warning system of claim 1, wherein said electronic circuit board is programmed such that an electronic signal is generated and sent to said alarm member only when an audio or electronic warning signal of an emergency vehicle of a chosen signal strength range is received.

5. The emergency vehicle warning system of claim 1, wherein said light member is formed as at least one light emitting diode (LED) light member.

6. The emergency vehicle warning system of claim 1, wherein said power supply includes at least one rechargeable battery member.

7. The emergency vehicle warning system of claim 1, wherein said power supply includes a power cord extending outside of said casing member and is adapted to releasably connect to a power source of said motor vehicle.

8. The emergency vehicle warning system of claim 1, further comprising at least one attachment member connected to an outside surface of said casing member top wall and adapted to releasably connect with an interior surface of said motor vehicle.

9. The emergency vehicle warning system of claim 8, wherein said at least one attachment member is formed as a hook and loop connector.

10. The emergency vehicle warning system of claim 8, wherein said at least one attachment member is formed as a double sided adhesive pad.

11. An emergency vehicle warning device disposed within a motor vehicle, said emergency vehicle warning device comprising:

a casing member including:

a top wall;

a bottom wall; and at least one side wall;

wherein said top wall, said bottom wall, and said at least one side wall form an interior volume;

a power supply;

an alarm member;

a vibrator;

a receiver unit including an electronic circuit board connected thereto adapted to be programmed to desired performance specifications;

wherein said receiver unit is located within said interior volume of said casing member and is adapted to detect audio and electronic warning signals transmitted by emergency vehicles;

wherein said receiver unit is adapted to send an electronic signal to an alarm member when an audio or electronic warning signal is received from said emergency vehicles;

wherein said electronic circuit board is programmed such that the electronic signal is generated and sent to said alarm member or to said vibrator only when an audio or electronic warning signal of an emergency vehicle of a chosen signal strength range is received;

wherein said alarm member is located within said interior volume of said casing member and is adapted to receive said electronic signal from said receiver unit and emit an alarm adapted to inform a driver of said motor vehicle of an emergency vehicle emitting an audio or electronic warning signal;

wherein said alarm member includes a speaker member, and at least one light member, wherein said alarm member is adapted to emit an audio noise, and flashing lights;

wherein the power supply is located within said interior volume of said casing member and is electronically connected to said receiver unit and said alarm member;

wherein the vibrator is located within said interior volume of said casing member and is adapted to emit vibrations;

wherein said vibrations are of an amplitude adapted to travel through said motor vehicle and be physically felt by a person in their extremities; and wherein said power supply includes a solar panel attached to an outside surface of said casing member top wall and is adapted to collect solar energy for storage within and to be used by said power supply.

12. An emergency vehicle warning apparatus disposed within a motor vehicle, said emergency vehicle warning apparatus comprising:

a casing member including:

a top wall;

a bottom wall; and at least one side wall;

wherein said top wall, said bottom wall, and said at least one side wall form an interior volume;

a power supply;

an alarm member;

a vibrator;

a receiver unit;

wherein said receiver unit is located within said interior volume of said casing member and is adapted to detect audio and electronic warning signals transmitted by emergency vehicles;

wherein said receiver unit is adapted to send an electronic signal to an alarm member when an audio or electronic warning signal is received from said emergency vehicles;

wherein said receiver unit comprises an electronic circuit board, wherein said electronic circuit board is programmed such that the electronic signal is generated and sent to said alarm member or to said vibrator only when an audio or electronic warning signal of an emergency vehicle of a chosen signal strength range is received;

wherein said alarm member is located within said interior volume of said casing member and is adapted to receive said electronic signal from said receiver unit and emit an alarm adapted to inform a driver of said motor vehicle of an emergency vehicle emitting an audio or electronic warning signal;

wherein said alarm member includes a speaker member, and at least one light member, wherein said alarm member is adapted to emit an audio noise, and flashing lights;

wherein the power supply is located within said interior volume of said casing member and is electronically connected to said receiver unit and said alarm member;

wherein the vibrator is located within said interior volume of said casing member and is adapted to emit vibrations;

wherein said vibrations are of an amplitude adapted to travel through said motor vehicle and be physically felt by a person in their extremities; and wherein said power supply includes a solar panel attached to an outside surface of said casing member top wall and is adapted to collect solar energy for storage within and to be used by said power supply.

* * * * *